United States Patent [19]

Hubble, III et al.

[11] 4,118,751

[45] Oct. 3, 1978

[54] CORONODE CONNECTION ARRANGEMENT

[75] Inventors: Fred F. Hubble, III, Rochester; John B. Tasseff, II, Webster, both of N.Y.

[73] Assignee: Xerox Corporation, Stamford, Conn.

[21] Appl. No.: 802,163

[22] Filed: May 31, 1977

[51] Int. Cl.[2] ..... H05F 3/00; H01T 19/00

[52] U.S. Cl. ..... 361/220; 29/628; 29/630 A; 250/324; 339/97 R; 361/230

[58] Field of Search ..... 361/220, 222, 229, 230; 29/628, 630 A; 250/324, 325, 326, 423; 339/97 R, 97 C; 355/3 CH

[56] References Cited

U.S. PATENT DOCUMENTS

| | | | |
|---|---|---|---|
| 3,908,127 | 9/1975 | Clark | 361/230 |
| 3,987,540 | 10/1976 | Gryctko | 29/628 |
| 4,016,455 | 4/1977 | Christiansen | 361/222 |
| 4,020,315 | 4/1977 | Euler | 250/325 |
| 4,039,239 | 8/1977 | Cobaugh et al. | 339/97 R |

*Primary Examiner*—Gerald Goldberg

[57] ABSTRACT

A corona discharge device having a coronode of the type including a wire electrode coated with a fractureable dielectric sleeve for example, glass. Electrical contact is made to the wire via a conductive member forcibly attached or crimped to the sleeve to fracture it sufficiently to permit direct contact between the wire and the member.

5 Claims, 9 Drawing Figures

CORONODE CONNECTION ARRANGEMENT

BACKGROUND OF THE INVENTION

This application is directed to corona device of the type generally used in depositing charges on chargeable surfaces of an electrostatic reproduction machine. More particularly, this invention is directed to a corona charging device of the type disclosed in copending application Ser. No. 748,805 in the joint names of T. Davis and G. Safford and assigned to the assignee of the present invention and more particularly to an arrangement for making electrical contact with, and placing under tension a dielectric coated wire coronode of the type disclosed therein.

One arrangement for mounting this type of corona device is shown in the aforementioned copending application in which the interior wire is extended beyond the ends of the dielectric sleeve and wound about a screw which is turned to render it taut. Variations of this arrangement are shown in U.S. Pat. No. 3,908,127. These methods are currently used in many commercial xerographic machines using bare wire corona electrodes. In such an arrangement the wire must be sufficiently strong to withstand the tensioning force.

An attempt at providing a suitable tensioning arrangement for a dielectric coated coronode is shown in copending application Ser. No. 751,827 in the name of J. Laing, also assigned to the same assignee as the present application. In that arrangement, the end portions of the dielectric coating are formed into enlarged masses which are biased or pressed against to hold the coronode taut. Electrical connection to the inner wire in this arrangement is by means of direct contact with the wire which is extended beyond the dielectric on at least one end of the coronode. This latter method suffers from the disadvantage of complicating the manufacture of the coronode itself, while nevertheless requiring the use of a separate contacting means to the wire.

A method of maintaining a tension on a conductive wire coronode of an corona charger of the type used in electrostatic reproduction machines is shown in copending application Ser. No. 783,359 in the name of Donald Weikel, also assigned to the assignee of the present application. In this application is disclosed a tensioning arrangement including a coil spring coaxially carried by one end of a corona wire, which spring is compressed or loaded between a fixed surface of a mounting block and a mass carried on the corona electrode outboard of the spring.

Yet a further arrangement for mounting a corona electrode of the bare wire or coated wire type is disclosed in concurrently filed application Ser. No. 802,165, also assigned to the assignee of this application, in the joint names of F. Hubble and J. Tasseff. This instant invention is directed to an alternative arrangement for incorporating a dielectric coated wire into the support and tensioning arrangement disclosed in the last named application.

OBJECTS & SUMMARY OF THE INVENTION

It is therefore an object of this invention to provide a novel arrangement for making electrical contact to a coronode of the type comprising a corona wire coated with a dielectric material.

A further object is an arrangement for maintaining a preselected tension on a coronode of the type having an inner conductive wire coated with a dielectric material for use in an electrostatic reproduction machine.

A still further object is to provide a corona device electrode tensioning and contact arrangement which overcomes the disadvantages of the prior art arrangements.

These and other objects and advantages of the invention are accomplished by making an electrical contact to a dielectric coated wire by means of a conductive mass crimped or otherwise forcefully attached onto the outer surface of the dielectric material which attachment results in electrical contact through the dielectric to the wire by fracturing and party pulverizing the dielectric. More specifically, this invention suggests that contact to a corona discharge electrode of the type including a wire coated with a fracturable dielectric sleeve may be made by compressing a conductive member onto the dielectric sleeve with sufficient force and to the extent necessary to fracture the sleeve and thereby bring the inner surface of the member into contact with the wire.

BRIEF DESCRIPTION OF THE DRAWINGS

The invention will be described with reference to the drawings in which.

DESCRIPTION OF THE PREFERRED EMBODIMENT

In its most elementary form this invention suggests that a voltage suitable to generate a corona discharge near a coronode comprising a wire coated with a frangible dielectric sleeve may be coupled to the wire by crimping a slotted conductive member to and through a frangible dielectric sleeve.

Figure 1:
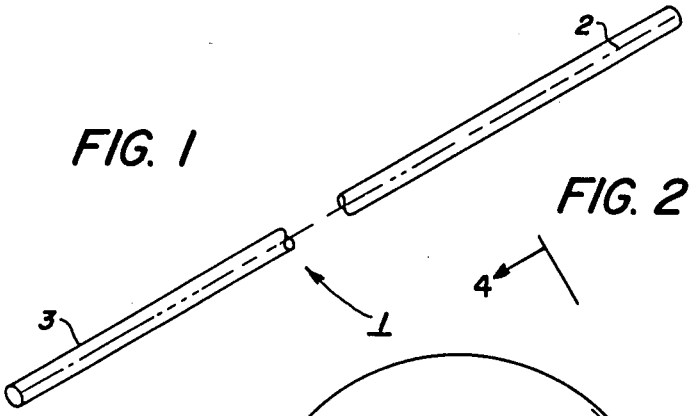
FIG. 1 illustrates a coronode of the type comprising a wire coated with a dielectric sleeve.

Referring to FIG. 1 there is illustrated a corona discharge electrode or coronode 1 for depositing charge onto an imaging surface of a xerographic reproduction machine in a well known manner. The coronode consists of a thin inner wire 2 coated with a dielectric sleeve 3. The construction of a coronode of this type is described in greater detail in the aforementioned copending application Ser. No. 748,805 and the disclosure of that application is hereby incorporated by reference. A preferred form of the coronode of this type comprises a thin coating of glass as the dielectric material. This glass coating in the form of thin elongated sleeve is carried on a flexible conductive wire and is very brittle and easily fractured during manufacture and handling.

In utilizing such coronodes in the prior art high voltage has been coupled directly to the inner corona wire by extending at least one of the ends of the wire through the dielectric sleeve at one end and attaching it to a high-voltage electrode. Such arrangements are illustrated in some of the patent applications alluded to above. In addition, the tension force required to hold the coronode in a taut condition in the charging device is also applied to the wire.

Figure 2:
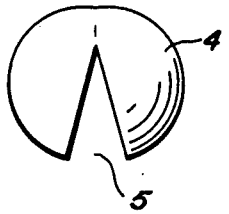
FIG. 2 illustrates a conductive member suitable for crimping onto and through the dielectric sleeve of the coronode.

This invention suggests the use of a slotted or open sided conductive member, such as the split ball 4 of FIG. 2 via which high voltage may be coupled to the wire element 2 of the coronode through the dielectric sleeve 3.

The member 4 is shown as being spherical in shape and having a generally V-shaped groove 5 therein. The member may be made of any electrically conductive material which is suitably deformable in the manner described in detail below.

Figure 3:
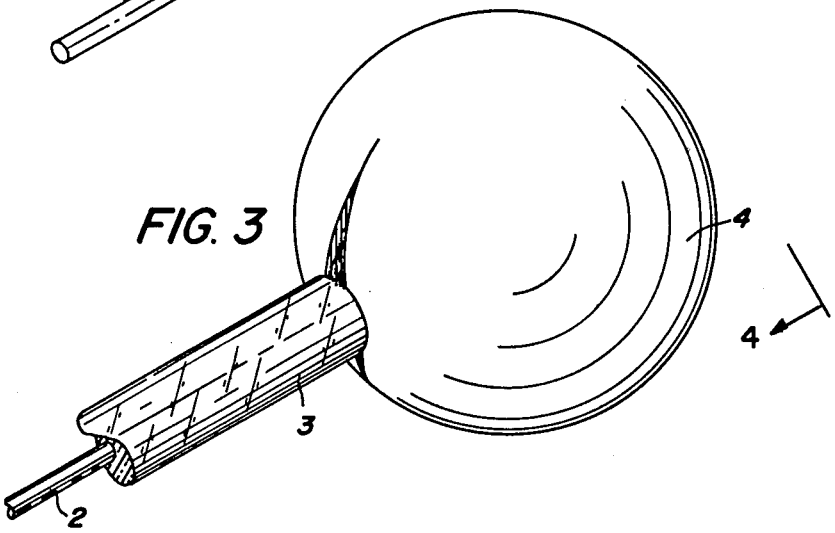
FIG. 3 shows a coronode with a conductive member crimped thereto.
Figure 4A:
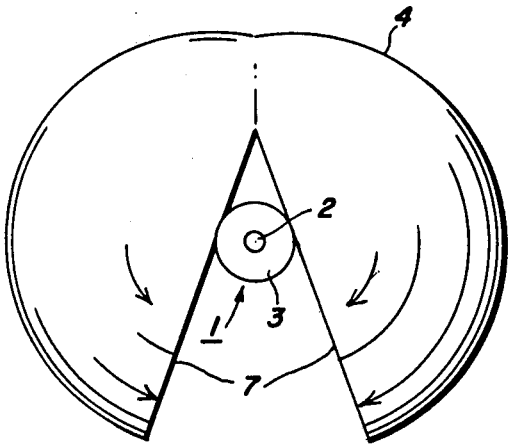
FIGS. 4*a* and 4*b* show cross section views of the conductive member on the coronode, before and after crimping, respectively.
Figure 4B:
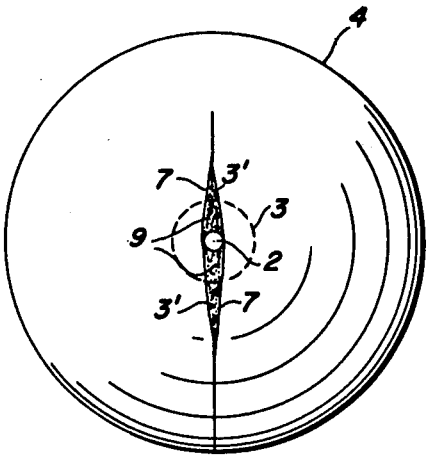

In the process of attaching the conductive member 4 to the coronode 2, the sphere 4 is simply placed on the coronode in a manner as shown in FIG. 4*a*, after which a crimping force is applied to the member in the direction of the arrows. As the force is applied the inner walls defining the groove 5 bear against the outer dielectric surface fracturing it and, in the case of glass, partly pulverizing it. The end result of the crimping action is shown in FIG. 4*b*, in which the inner walls of the member are slightly deformed into arcuate depressions 7 which conform in the outer surface of the inner wire in areas contiguous with the wire. Voids or cavities 9 on opposed sides of the wire 2 are formed by the crimping process, which voids are filled with pulverized or powdered glass 3', remnants of the crimping process. The exterior appearance of the resulting crimped coronode is shown in FIG. 3.

The resulting crimped coronode shown in FIG. 3 may be mounted in a coronode mounting and tensioning apparatus disclosed in concurrently filed application Ser. No. 802,165, referred to hereinbefore and a description of that mounting structure follows.

Referring to FIGS. 5–8, the crimped coronode 50 of the invention as shown in FIG. 3 is illustrated as being supported between insulating end block assemblies 20 and 40. The assemblies 20 and 40 are held a fixed distance apart by means of a rigid insulating support plate 60 (FIG. 5) to which the assemblies may be fastened by conventional means such as insulating screws (not shown). The end block assemblies 20 and 40 are extruded of a high dielectric strength insulator such as polyvinylchloride or nylon. The assembly 40 permits connection to a high voltage supply for application of a corona generating potential to the coronode 50 as described in greater detail hereinafter. The assembly 40 comprises two approximate half-sections 41 and 61 which are held together in mating relationship by means of three screws 62 or other similar fastening devices. If the screws 62 are made of a conductive material, they are located far enough from any of the other conductive parts (and high voltage applied thereto) of the assembly so as not to provide a potential corona forming surface. Alternatively, the screws may be made of a suitable dielectric, such as nylon.

The lower half-section 41 is formed with a thick walled segment 43 and a thin walled segment 44 which give the section 41 the overall two stepped appearance, the upper step being associated with the thick wall segment 43, and the lower step being associated with the thin walled segment 44.

The thick walled segment 43 is characterized by a generally planar land 45 which forms the outer and uppermost periphery of a central cavity 46, the cavity having a generally rectangular shape when viewed in plan and open at the top. The cavity extends from the level of the land 45 to a level somewhat greater than half the depth of the segment 43. A suitably shaped conductive insert 47 is fitted into the cavity 46 and is provided with a pair of coronode holding slots 48 in the innermost wall and a top or internally threaded hole in the opposed outermost wall. The insert 47 couples the high voltage from a suitable power supply (not shown) via a terminal 51 of the coronode 50. For this purpose the terminal consists of an outer insulative sleeve 52 and an inner conductor 53, the sleeve covering only a portion of the conductor—approximately midway of its length.

The conductor 53 is threaded on one end and passes through a hole in the outermost wall of the section 41 into threaded engagement with the aforementioned internally threaded top in the far wall of the insert. The diameter of the hole in the section 41 through which the conductor 53 passes is selected to be only slightly greater than the diameter of the conductor 53 so that when inserted, the shoulders of the outer sleeve 52 abut the outer wall of the section 41 to limit inward movement of the terminal 51 and hold it in the position shown best in FIG. 8. The outer sleeve may be formed integrally with the end block half-section 41. The insert 47 may take a variety of shapes in line with its function of coupling high voltage from the terminal 51 to the coronodes 50 and while a box-like or rectangular construction open on the top and bottom is illustrated, several other shapes would function acceptably.

The slots 48 in the insert 47 are arranged adjacent similarly shaped slots 71 in the thick walled section 43. The aligned slot pairs define a channel through which one end of the coronodes 50 pass. The coronodes are provided with beaded conductors 72 on the ends thereof, the diameters of the beads exceeding the width of the slots 48 so that, as tension is placed on the opposite end of the coronode the beads 72 abut the interior wall of the wall of the insert 47 and thereby complete a conductive path back to the terminal 51 through the insert 47.

The thin walled segment 44 is provided with upstanding bosses 73 running parallel to the coronode 50 which interfit into complementary shaped recesses in the half-section 61 to facilitate assembly and provide self alignment. A pair of passageways 74 are provided in the segment 44 through which the coronodes pass, the passageways extending from the edge of the segment 44, through the entire length of the segment 44. Each passageway 44 and slots 71 and 48 combine to provide a conduit for the coronodes 50.

The upper half-section 61 of the assembly 40 is shaped to complement or mate with the above described lower half-section 41. For this purpose, it comprises a thin-walled segment 85 and a thick-walled segment 84, the segment 84 overlying and complementing the segment 44 and the segment 85 overlying and complementing the segment 45. The thick-walled segment has recesses 86 which mate with the bosses 73 on the segment 44. The thin walled segment 85 carries a conductive plate 86 which is positioned to form the top wall of the cavity 46 in the lower half-section by snuggly fitting into the top portion of the insert. The insert 47 and member 86, when the half-sections are joined jointly, define a semi-closed conductor lined enclosure for inhibiting corona on the beads and limiting upward movement of the bead.

The end block assembly 20, located remote from the high voltage terminal 51, is comprised of an upper half-section 91 which is generally analogous to the upper half-section 61 previously described and will be therefore described only briefly. The section 91 comprises a thick walled segment 92 and a thin walled segment 93 forming a two stepped member shaped to mate or interfit with corresponding formation the lower section 121. For this purpose, it includes a pair of recesses 110 which mate with upstanding bosses on the lower half-section and a pair of conductive members 111 serve to substantially close the conductor lined cavities in the lower half-section 121. Threaded openings are provided to accept dielectric screws 122 which hold the sections 91 and 121 together.

The lower half-section 121 is formed with a thick walled segment 143 and a thin walled segment 144 which also give the section 121 an overall two stepped appearance, the upper step being associated with the thick walled segment 143, and the lower step being associated with the thin walled segment 144.

The thick walled segment 143 is characterized by a generally planar land 145 which has formed therein a pair of cavities 146, the cavities having a generally rectangular shape when viewed in plan. The cavities extend from the level of the land 145 to a level somewhat greater than half the depth of the segment 143. A suitably shaped conductive insert 147 is fitted into each cavity 146 and is provided with a slot 149. The insert 147 serves to anchor two coronode ends and provide a corona suppressing enclosure at which to terminate the high voltage. The insert 147 may take a variety of shapes in line with the functions noted above and while a box-like or rectangular construction open on the top and bottom is illustrated, several other shapes would function acceptably.

The slots 149 in the insert 147 is arranged adjacent similarly shaped slots 171 in the thick walled section 143. The aligned slot pairs define a channel through which the end of the coronode 50 farthest removed from the high voltage supply passes. The coronodes are provided with beaded conductors 172 on the ends thereof.

The thin walled segment 144 is provided with upstanding bosses 173 running parallel to the coronodes 50 which interfit into the complementary shaped recesses 110 in the half-section 93, as described above. These bosses facilitate assembly and provide self alignment in a manner similar to the bosses 73 on the section 41. A pair of passageways 174 are provided in the segment 144 through which the coronodes ends pass, the passageways extending from the edge of and through the entire length of the segment 144. Each passageway 174 joins with pair of slots 171 and 149 to jointly form a conduit for a pair of coronode ends.

The ends of the coronode remote from the high voltage supply also have pressed thereon beaded conductors 172 or alternatively may be knotted or crimped to provide similar enlarged end portions.

Figure 7:
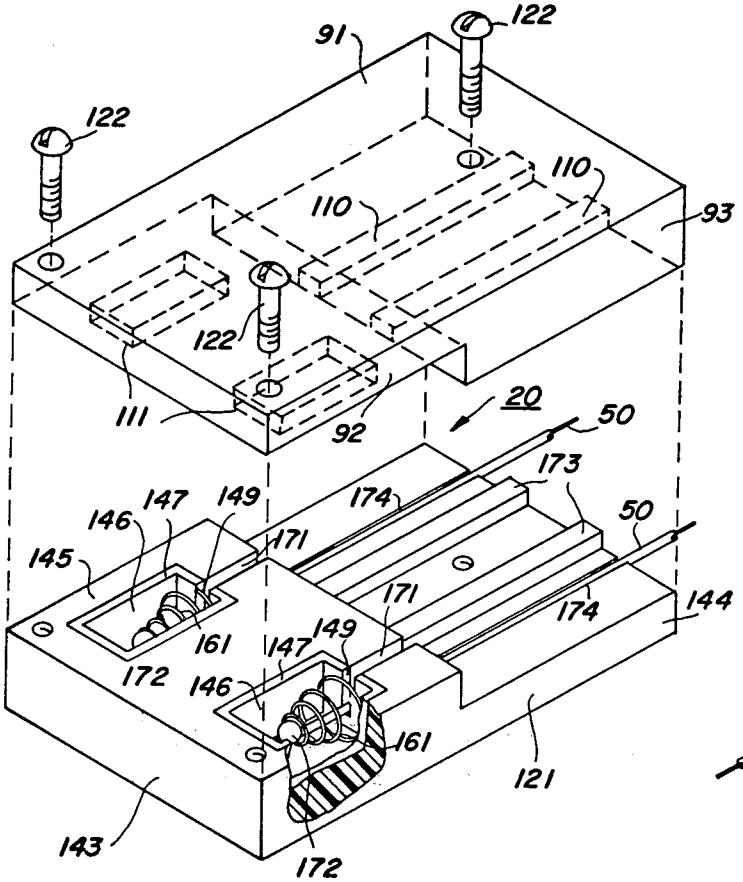
FIG. 7 is an exploded view similar to FIG. 6 of the opposite end of the embodiment shown in FIG. 5.
Figure 8:
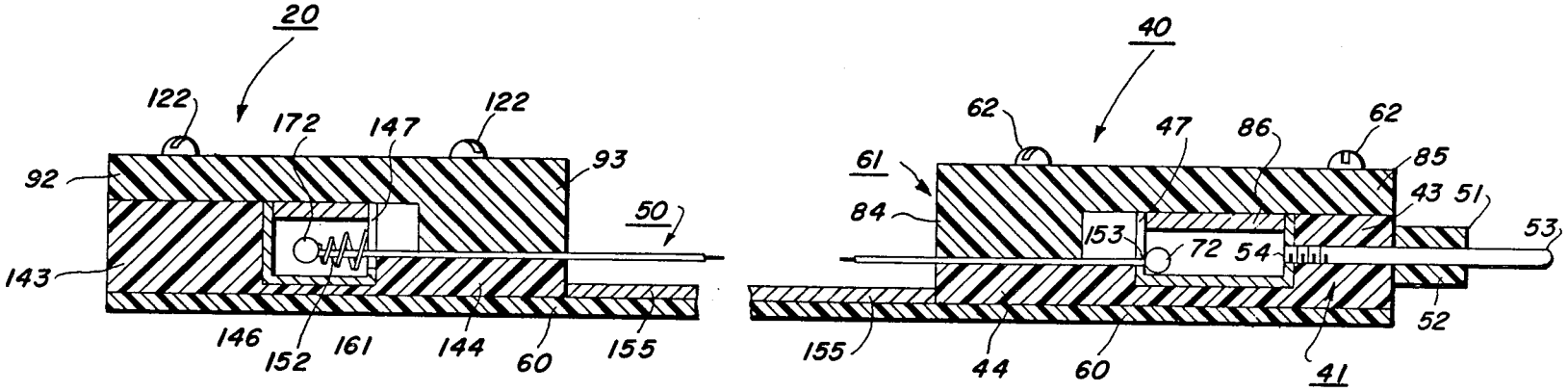
FIG. 8 is a side view partly broken away of the mounting structure of the invention.

A pair of compressible resilient means, compression springs 161, are provided to urge the ends of the coronodes 50 in the direction of the adjacent end of the device, i.e., outwardly. To provide tension the ends of the coronode are threaded inside the springs 161 during the assembly of the device and the springs 161 are located in the insert 147 as shown in FIG. 7. It is noted that the compression springs 161 are tapered from one end to the other, the broadest end being located to abut the insert 147 adjacent the slot 149 and the narrow end thereof being in abutment with the bead 172. For this purpose, of course, the bead is made of a diameter which exceeds the opening in the tapered end of the spring 161. By slecting the width of the broadest portion of the spring 161 to be justly slightly smaller than the width of the insert lateral movement of the spring in the insert is minimized. Lateral movement of the corona discharge portion of the coronodes 50 is also substantially minimized by selecting the width of the slots 149 and 171 and passageways 174, and also the corresponding slots and passageways on the opposite end block assembly to be sufficiently narrow to restrict movement of the coronodes 50. The compression springs 172 counteract any "creep" or stretching of the coronodes and, unlike tension springs, they cannot be overstretched during assembly or use.

The crimped coronode 50 with the conductive members attached as shown in FIGS. 1–3 is assembled into the above described mounting structure as follows. The compression springs are first threaded onto the ends of the coronode interior of the crimped members. One end of the coronode with its attached spring is then inserted into the cavity 146. The sleeve or dielectric coating is concurrently placed in the passageway 174. The opposite end of the coronode is grasped and put under tension so that the beads 72 may be inserted over the slot 48 while concurrently placing the other end of the glass or dielectric sleeve in the passageway 74. It will be noted that, the passageways 74 and 174 provide a base or support on which the ends of the dielectric coating rest, while a tension or bias is applied to the wire coronode by the spring 161 operating on the interior wire only. This latter feature helps prevent breakage or splitting of the outer sleeve during use of the corona device. The threaded end of the terminal 51 is then threaded into the top in the insert 47.

Assembly of the end block is then completed by attaching the upper half-sections 61 and 91 to the lower half-section by means of the attaching screws.

Figure 5:
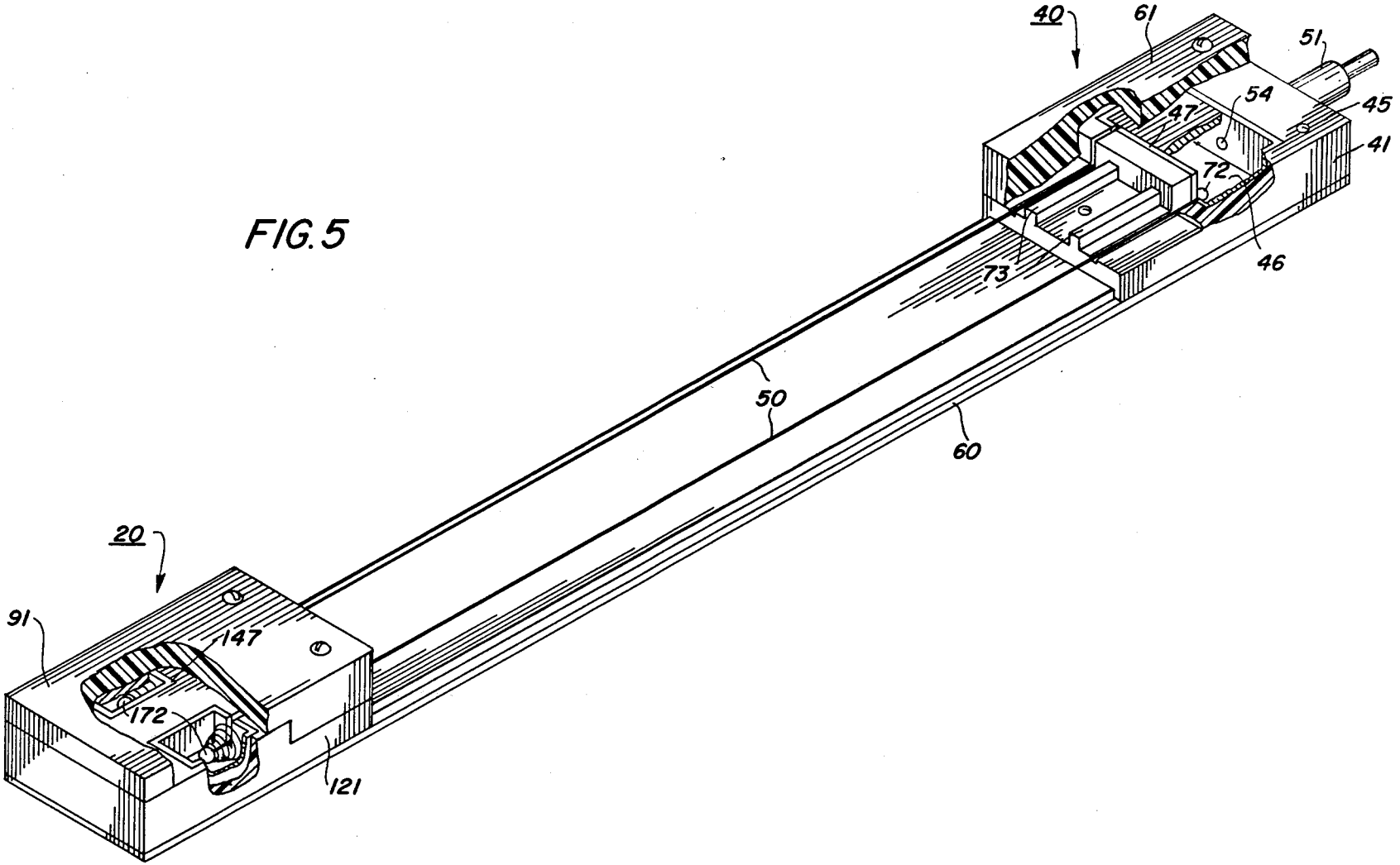
FIG. 5 is a perspective view of the coronode of the invention incorporated into a corona generating device, and broken away for clarity.
Figure 6:
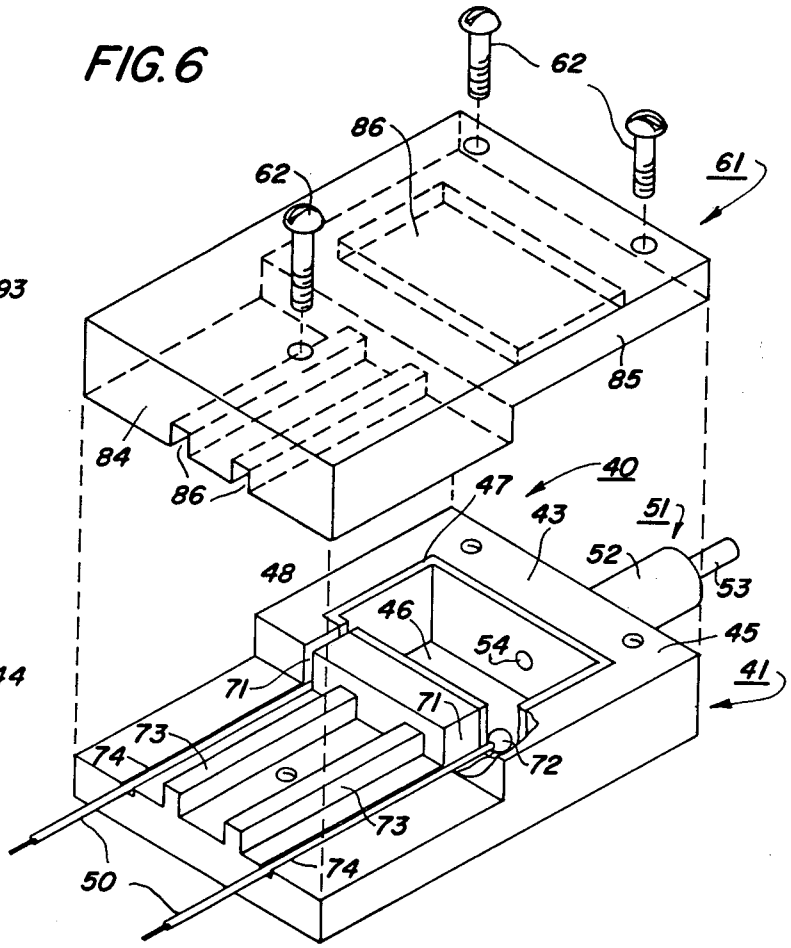
FIG. 6 is an exploded view of one end of the structure shown in FIG. 2 showing the details of mounting assembly on the high voltage supply side of the coronode.

For controlling the deposition of charge by the corona device of the invention there may be provided a biased or grounded conductive plate or shield 155, FIG. 5. This shield 155 may be attached to the connecting plate 60 by any suitable means such as an adhesive or by screws or the like or may be fitted into a slot or channel in the member 60 of the type generally similar to that shown in U.S. Pat. No. 3,908,127.

The mounting structure has been described as including a planar support member 60 but it is equally possible to utilize a support member which is generally U-shaped in cross-section with the end block assembly supported by any suitable means at opposed ends of the channel.

While the invention has been described in connection with a specific examplary embodiment thereof, it will be understood that many modifications will be readily apparent to those of ordinary skill in the art; and that this application is intended to cover any adaptations or variations thereof.

For example, the support member 60 may be formed as a unit with either or both of the sections 41 and 121 with the support 60 being U-shaped or some other suitable shape known in the art. Any well known method of forming the plastic units intergrally may be used for this purpose.

In addition, instead of using secrews to fasten the various sections together, biased or resilient clips or flanges which cooperate with suitable recesses may be provided on the parts to be joined.

What is claimed is:

1. A corona discharge device comprising a coronode, said coronode including an inner wire coated with a frangible dielectric and a conductive member carried on at least one end of said coronode, said member fracturing said dielectric material to contact said inner wire.

2. The combination recited in claim 1 wherein said member comprises a metal sphere having a groove formed therein to straddle said coronode.

3. The combination recited in claim 1 wherein said dielectric is glass.

4. The combination recited in claim 3 wherein said member comprises a metal sphere having a groove formed therein to straddle said coronode.

5. The method of making electrical contact to a elongated wire coated with a frangible dielectric comprising the steps of partly surrounding said dielectric with a conductive compressible member, and applying a force to said member to compress it onto said dielectric and fracture said dielectric to result in direct contact between said member and said wire.

* * * * *